US007995954B2

(12) United States Patent
Kudo et al.

(10) Patent No.: US 7,995,954 B2
(45) Date of Patent: Aug. 9, 2011

(54) DEVELOPING DEVICE AND IMAGE FORMING APPARATUS INCLUDING SAME WHICH INCLUDES A SUPPLY PATH AND A RECOVERY PATH

(75) Inventors: Norio Kudo, Kawasaki (JP); Yasuo Miyoshi, Yokohama (JP); Hisashi Kikuchi, Kawasaki (JP); Nobuo Iwata, Sagamihara (JP); Tsukuru Kai, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 191 days.

(21) Appl. No.: 12/401,209

(22) Filed: Mar. 10, 2009

(65) Prior Publication Data

US 2009/0232558 A1 Sep. 17, 2009

(30) Foreign Application Priority Data

Mar. 11, 2008 (JP) ..... 2008-061533

(51) Int. Cl.
*G03G 15/08* (2006.01)

(52) U.S. Cl. ..... 399/254

(58) Field of Classification Search ..... 399/254, 399/255, 256, 272, 281, 282
See application file for complete search history.

(56) References Cited

U.S. PATENT DOCUMENTS

| | | | | |
|---|---|---|---|---|
| 4,978,997 | A * | 12/1990 | Bell | 399/256 |
| 6,259,876 | B1 * | 7/2001 | Fukuda et al. | 399/254 |
| 7,046,945 | B2 * | 5/2006 | Nishitani et al. | 399/254 |
| 7,356,288 | B2 | 4/2008 | Iwata et al. | |
| 7,426,360 | B2 * | 9/2008 | Arimoto et al. | 399/254 |
| 7,466,944 | B2 * | 12/2008 | Bessho | 399/254 |
| 2005/0031381 | A1 * | 2/2005 | Arimoto | 399/258 |
| 2007/0166079 | A1 | 7/2007 | Ichikawa et al. | |
| 2007/0264053 | A1 | 11/2007 | Iwata et al. | |
| 2007/0274740 | A1 | 11/2007 | Katoh et al. | |
| 2008/0038019 | A1 | 2/2008 | Kasahara et al. | |
| 2008/0056747 | A1 | 3/2008 | Miyoshi | |
| 2008/0145107 | A1 | 6/2008 | Miyoshi | |
| 2008/0298845 | A1 | 12/2008 | Ohmura et al. | |
| 2008/0298866 | A1 | 12/2008 | Matsumoto et al. | |

FOREIGN PATENT DOCUMENTS

| | | | |
|---|---|---|---|
| JP | 10149022 | A * | 6/1998 |
| JP | 10260571 | A * | 9/1998 |
| JP | 3104722 | | 9/2000 |
| JP | 2002-6599 | | 1/2002 |
| JP | 2002-236420 | | 8/2002 |
| JP | 2003-263012 | | 9/2003 |
| JP | 2004-133339 | | 4/2004 |
| JP | 2007316495 | A * | 12/2007 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A developing device including a developer container casing, a developer bearing member to supply toner to a latent image, a supply path to convey developer in an axial direction of the developer bearing member, a supply conveyance member to apply a force to the developer in the supply path to convey the developer, a recovery path to return the developer reaching a downstream end of the supply path to an upstream end of the supply path relative to a direction of conveyance of the developer, and a recovery conveyance member to apply a force to the developer in the recovery path to convey the developer. A bottom surface of the supply path is tilted such that the bottom surface at the downstream end of the supply path relative to the direction of conveyance of the developer is lower than the bottom surface at the upstream end of the supply path.

10 Claims, 4 Drawing Sheets

DEVELOPING DEVICE AND IMAGE FORMING APPARATUS INCLUDING SAME WHICH INCLUDES A SUPPLY PATH AND A RECOVERY PATH

CROSS-REFERENCE TO RELATED APPLICATIONS

The present patent application is based on and claims priority pursuant to 35 U.S.C. §119 from Japanese Patent Application No. 2008-061533, filed on Mar. 11, 2008 in the Japan Patent Office, the entire contents of which are incorporated herein by reference.

BACKGROUND OF THE INVENTION

1. Field of the Invention

Exemplary aspects of the present invention generally relate to a developing device employed in a copier, a printer, a facsimile machine, and so forth, and an image forming apparatus including the developing device.

2. Description of the Background

Related-art image forming apparatuses, such as a copier, a facsimile machine, a printer, or a multifunction printer having two or more of copying, printing, scanning, and facsimile functions, form a toner image on a recording medium (e.g., a sheet) according to image data using an electrophotographic method. In such a method, for example, a charger charges a surface of an image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

Because it provides better durability and image forming performance, an image forming apparatus employing a developing device using a two-component developer including toner and a magnetic carrier is now widely used in electrophotography. The developing device using the two-component developer typically includes a supply path and a recovery path. The supply path supplies the developer to a developing sleeve serving as a developer bearing member while conveying the developer in a direction parallel to an axial direction of the developing sleeve. The recovery path returns the developer reaching a downstream end of the supply path to an upstream end thereof.

In some of the above-described developing devices including the supply path and the recovery path described above, the developer supplied from the supply path to the developing sleeve is returned to a downstream end of the supply path after development of a latent image, that is, after passing through a developing area where the developing sleeve and a photoconductor serving as a latent image bearing member contact each other. Some of the toner is supplied to the latent image formed on the photoconductor at the developing area, toner density declines. As a result, the toner density of the developer at the downstream end of the supply path relative to a direction of conveyance of the developer is decreased due to the developer having lower toner density being returned to the supply path, causing deterioration in image quality.

Published Unexamined Japanese Patent Application No. (hereinafter referred to as JP-A-) H05-333691 discloses a developing device including a supply path and a recovery path, disposed in parallel to a developing sleeve. In the developing device, developer supplied to the developing sleeve is conveyed to the recovery path after development, that is, after passing through a developing area. Specifically, the developer having lower toner density after passing through the developing area is not returned to the supply path but is instead conveyed to the recovery path. As a result, the toner density of the developer at a downstream end of the supply path relative to a direction of conveyance of the developer is not decreased.

However, in such a developing device, because the developer supplied from the supply path to the developing sleeve is not returned to the supply path, an amount of the developer at the downstream end of the supply path relative to the direction of conveyance of the developer is reduced. When unevenness in the amount of the developer occurs between the downstream and upstream ends of the supply path, the developer is unevenly supplied to the developing sleeve in an axial direction of the developing sleeve.

Specifically, the developer is evenly supplied to the developing sleeve at the upstream end of the supply path where a sufficient amount of the developer is present, providing stable image density. By contrast, the developer is not evenly supplied to the developing sleeve at the downstream end of the supply path where a smaller amount of the developer is present, causing uneven image density and irregular images.

To solve such problems, in the developing device disclosed in JP-A-H05-333691, a sufficiently larger amount of the developer is conveyed in the supply path compared with an amount of the developer supplied to the developing sleeve, making up for developer lost when supplied to the developing sleeve. As a result, unevenness in the amount of the developer in the supply path in the direction of conveyance of the developer can be reduced, preventing uneven image density.

However, in the above-described developing device, a driving speed of a developer conveyance member provided in the supply path is increased in order to increase conveyance speed of the developer so that the sufficiently larger amount of the developer is conveyed in the supply path. Consequently, larger stress is applied to the developer. Further, in a case in which a conveyance screw is used as the developer conveyance member, torque of the conveyance screw is increased when a rotation speed of the conveyance screw is increased in order to increase the conveyance speed of the developer in the supply path, and it is not possible to increase the amount of developer conveyed in the supply path sufficiently to prevent large stress to the developer and high torque of the conveyance screw.

SUMMARY

In view of the foregoing, illustrative embodiments of the present invention provide a developing device in which developer supplied from a supply path to a developer bearing member is conveyed to a developer path other than the supply path after passing through a developing area. As a result, stress to the developer can be prevented, and unevenness in an amount of the developer conveyed in the supply path in a direction of conveyance of the developer can be reduced. Illustrative embodiments of the present invention further provides an image forming apparatus including the developing device.

In one illustrative embodiment, a developing device includes a developer container casing, a developer bearing member housed partially within the developer container casing and rotated while bearing developer on a surface thereof to supply toner to a latent image to develop the latent image with the toner, a supply path inside the developer container casing to convey the developer in an axial direction of the developer bearing member while supplying the developer to the developer bearing member, a supply conveyance member disposed within the supply path to apply a force to the developer in the supply path to convey the developer, a recovery path inside the developer container casing to return the developer reaching a downstream end of the supply path to an upstream end of the supply path relative to a direction of conveyance of the developer, and a recovery conveyance member disposed within the recovery path to apply a force to the developer in the recovery path to convey the developer. An interior of the developer container casing is divided by a partition that separates and defines the supply path and the recovery path. The partition contains a hole through which the supply path and the recovery path communicate. A bottom surface of the supply path is tilted such that the bottom surface at the downstream end of the supply path relative to the direction of conveyance of the developer is lower than the bottom surface at the upstream end of the supply path.

Another illustrative embodiment provides an image forming apparatus including a latent image bearing member, a charger to charge a surface of the latent image bearing member, a latent image forming unit to form an electrostatic latent image on a surface of the latent image bearing member, and a developing unit to develop the electrostatic latent image with toner to form a toner image. The developing unit includes the developing device described above.

Another illustrative embodiment provides a developing device including developer container means for containing developer; developer bearing means housed partially within the developer container means and rotated while bearing developer on a surface thereof to supply toner to a latent image to develop the latent image with the toner; supply means disposed inside the developer container means for conveying the developer in an axial direction of the developer bearing means while supplying the developer to the developer bearing means, and including supply conveyance means for applying a force to the developer in the supply means to convey the developer; recovery means disposed inside the developer container means for returning the developer reaching a downstream end of the supply means to an upstream end of the supply means relative to a direction of conveyance of the developer, and including recovery conveyance means for applying a force to the developer in the recovery means to convey the developer; and partitioning means within the developer container means for separating and defining the supply means and the recovery means. The partition means contains a hole through which the supply means and the recovery means communicate. A bottom surface of the supply means is tilted with respect to a horizontal plane such that the bottom surface at the downstream end of the supply means relative to the direction of conveyance of the developer is lower than the bottom surface at the upstream end of the supply means.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
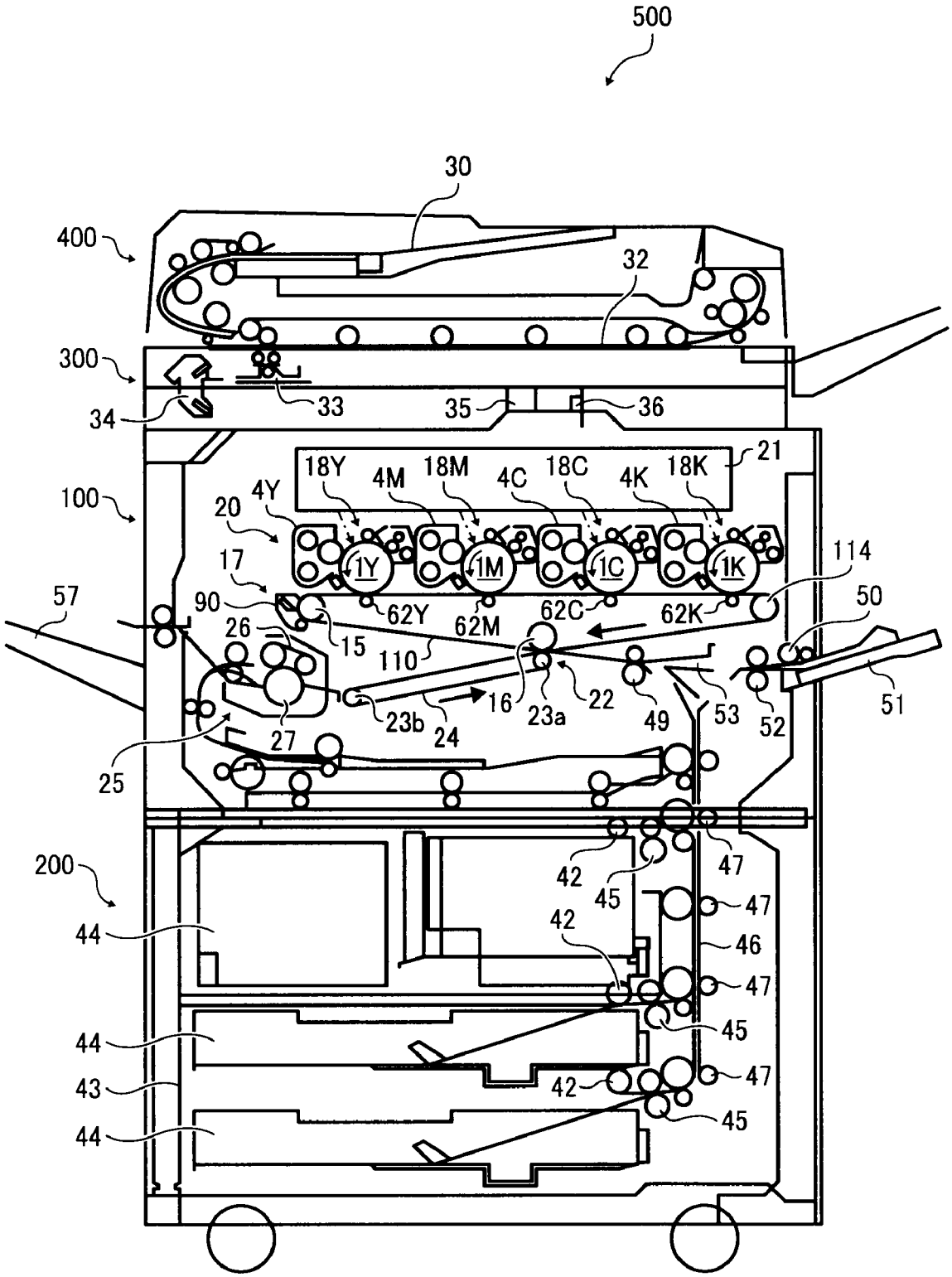
FIG. 1 is a schematic view illustrating an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a tandem-type color laser printer (hereinafter referred to as an image forming apparatus 500) according to illustrative embodiments. In the image forming apparatus 500, multiple photoconductors are parallel to one another.

FIG. 1 is a schematic view illustrating the image forming apparatus 500 according to illustrative embodiments. The image forming apparatus 500 includes, as main components thereof, a printer 100, a paper feeder 200 provided below the printer 100, a scanner 300 fixed onto the printer 100, and an automatic document feeder (ADF) 400 fixed onto the scanner 300.

The printer 100 includes an image forming unit 20 including four process cartridges 18Y, 18M, 18C, and 18K (hereinafter collectively referred to as process cartridges 18) of a specific color, specifically yellow (Y), cyan (C), magenta (M), or black (K). The process cartridges 18 are configured to form images of yellow, cyan, magenta, or black, respectively. Letters Y, M, C, and K suffixed to each reference numeral hereinafter indicate components used for forming images of yellow, cyan, magenta, or black. The image forming unit 20 further includes an optical writing unit 21, an intermediate transfer unit 17, a secondary transfer unit 22, a pair of registration rollers 49, a fixing device 25 using a belt fixing method, and so forth.

The optical writing unit 21 includes a light source, a polygon mirror, an f-θ lens, and a reflection mirror, each of which is not shown, and directs laser light onto a surface of a photoconductor to be described in detail below, based on image data.

Each of the process cartridges 18 includes a drum-type photoconductor 1, a charger, not shown, a developing device 4, a drum cleaning device, not shown, a neutralizing device, not shown, and so forth.

A configuration of the process cartridge 18Y is described in detail below as an example of the process cartridges 18 included in the image forming apparatus 500. The process cartridges 18C, 18M, and 18K have the same configuration as that of the process cartridge 18Y, and operate in a similar manner as the process cartridge 18Y, unless otherwise noted.

As described above, the process cartridge 18Y includes a drum-type photoconductor 1Y, a charger, not shown, a developing device 4Y, a drum cleaning device, not shown, a neutralizing device, not shown, and so forth. When image formation is started, the charger evenly charges a surface of the photoconductor 1Y. Subsequently, laser light modulated and deflected by the optical writing unit 21 is directed to the surface of the photoconductor 1Y thus charged. Accordingly, potential on the surface of the photoconductor 1Y to where the laser light is directed is decreased to form an electrostatic latent image of yellow on the surface of the photoconductor 1Y. The developing device 4Y develops the electrostatic latent image thus formed with toner of yellow to form a toner image of yellow.

The toner image of yellow thus formed on the surface of the photoconductor 1Y is primarily transferred onto an intermediate transfer belt 110 to be described in detail later. Toner particles remained on the surface of the photoconductor 1Y after primary transfer is removed by the drum cleaning device.

Thereafter, the neutralizing device neutralizes the photoconductor 1Y, and the charger evenly charges the surface of the photoconductor 1Y for next image formation. A series of processes described above is performed by the process cartridges 18M, 18C, and 18K in a similar manner.

A description is now given of an intermediate transfer unit 17 provided in the image forming apparatus 500.

The intermediate transfer unit 17 includes the intermediate transfer belt 110, a belt cleaning device 90, an extension roller 114, a driving roller 15, a secondary transfer backup roller 16, four primary transfer bias rollers 62Y, 62M, 62C, and 62K (hereinafter collectively referred to as primary transfer bias rollers 62), and so forth.

The intermediate transfer belt 110 is stretched by the multiple rollers including the extension roller 114, and seamlessly rotated in a clockwise direction in FIG. 1 along with rotation of the driving roller 15 rotated by a belt driving motor, not shown.

Each of the four primary transfer rollers 62 contacts an inner surface of the intermediate transfer belt 110, and primary transfer bias is applied thereto from a power source, not shown. Specifically, the primary transfer bias rollers 62 are pressed against the inner surface of the intermediate transfer belt 110 toward the photoconductors 1 to form primary transfer nips therebetween. A primary transfer magnetic field is formed at each of the primary transfer nips between the photoconductors 1 and the primary transfer bias rollers 62 due to the primary transfer bias applied to the primary transfer bias rollers 62.

The toner image of yellow formed on the surface of the photoconductor 1Y is primarily transferred onto the intermediate transfer belt 110 due to the primary transfer magnetic field and a pressure applied to the primary transfer nip. Toner images of magenta, cyan, and black respectively formed on surfaces of the photoconductors 1M, 1C, and 1K are also primarily transferred and sequentially superimposed on the toner image of yellow on the intermediate transfer belt 110. Accordingly, a toner image of four colors (hereinafter referred to as a full-color toner image) is formed on the intermediate transfer belt 110 during primary transfer.

The full-color toner image formed on the intermediate transfer belt 110 is secondary transferred onto a transfer sheet serving as a recording medium, not shown, at a secondary transfer nip to be described in detail later. Toner particles remaining on the surface of the intermediate transfer belt 110 after passing the secondary transfer nip is removed by the belt cleaning device 90. As illustrated in FIG. 1, the intermediate transfer belt 110 is sandwiched between the driving roller 15 and the belt cleaning device 90.

A description is now given of the secondary transfer device 22 provided in the image forming apparatus 500.

The secondary transfer device 22 is provided below the intermediate transfer unit 17. The secondary transfer device 22 includes a sheet conveyance belt 24 stretched between two extension rollers 23*a* and 23*b*. The sheet conveyance belt 24 is seamlessly rotated in a counterclockwise direction in FIG. 1 along with rotation of at least one of the extension rollers 23*a* and 23*b*. The intermediate transfer belt 110 and the sheet conveyance belt 24 are sandwiched between the extension roller 23*a* and the secondary transfer backup roller 16 of the intermediate transfer unit 17. As a result, the secondary transfer nip is formed where the intermediate transfer belt 110 of the intermediate transfer unit 17 contacts the sheet conveyance belt 24 of the secondary transfer device 22. A secondary transfer bias having a polarity opposite that of the toner is applied to the extension roller 23*a* from a power source, not shown, to form a secondary transfer magnetic field at the secondary transfer nip for electrostatically transferring the full-color toner image formed on the intermediate transfer belt 110 toward the extension roller 23*a*. The transfer sheet is conveyed to the secondary transfer nip by the pair of registration rollers 49 in synchronization with the full-color toner image formed on the intermediate transfer belt 110, and the full-color toner image is secondarily transferred onto the transfer sheet due to the secondary transfer magnetic field and a pressure applied to the secondary transfer nip. In place of applying the secondary transfer bias to the extension roller 23*a*, a charger configured to charge the transfer sheet in a contactless manner may be provided to the secondary transfer device 22.

The paper feeder 200 provided at the bottom of the image forming apparatus 500 includes multiple paper feed cassettes 44 for storing a stack of multiple transfer sheets therein. The multiple paper feed cassettes 44 are arranged one above another in a vertical direction. In each of the multiple paper feed cassettes 44, a paper feed roller 42 is pressed against a transfer sheet placed at the top of the stack of the transfer sheets. The paper feed roller 42 is rotated to convey the transfer sheet in the paper feed cassette 44 to a paper feed path 46.

The paper feed path 46 includes multiple pairs of conveyance rollers 47 and the pair of registration rollers 49 provided near the end of the paper feed path 46. The transfer sheet conveyed to the paper feed path 46 is further conveyed to the pair of registration rollers 49 and sandwiched therebetween. Meanwhile, in the intermediate transfer unit 17, the full-color toner image formed on the intermediate transfer belt 110 is conveyed to the secondary transfer nip along with seamless rotation of the intermediate transfer belt 110. The pair of registration rollers 49 conveys the transfer sheet sandwiched therebetween to the secondary transfer nip in synchronization with the full-color toner image so that the full-color toner image is secondarily transferred onto the transfer sheet. Thereafter, the transfer sheet having the full-color toner image thereon passing through the secondary transfer nip is conveyed to the fixing device 25 along with seamless rotation of the sheet conveyance belt 24.

The fixing device 25 includes a belt unit in which a fixing belt 26 is stretched between two rollers and is seamlessly rotated, and a pressing roller 27 pressed against one of the two rollers. The fixing belt 26 and the pressing roller 27 contact each other to form a fixing nip, and the transfer sheet conveyed from the sheet conveyance belt 24 is sandwiched between the fixing belt 26 and the pressing roller 27 at the fixing nip. The one of the two rollers against which the pressing roller 27 is pressed includes a heat source, not shown, to heat the fixing belt 26. The fixing belt 26 thus heated heats the transfer sheet at the fixing nip, and the full-color toner image is fixed to the transfer sheet by the heat and pressure applied to the transfer sheet.

The transfer sheet to which the full-color toner image is fixed by the fixing device 25 is discharged to a paper stack 57, shown on the left side in FIG. 1, provided to an exterior surface of the image forming apparatus 500, or returned to the secondary transfer nip to form a full-color toner image on a back side of the transfer sheet.

When documents, not shown, are copied, for example, a stack of the documents is placed on a document stand 30 of the ADF 400. However, when the documents are bound like a book, the documents need to be placed on a contact glass 32. To place such documents on the contact glass 32, the ADF 400 is opened from the image forming apparatus 500 to expose the contact glass 32 of the scanner 300. The documents are placed on the contact glass 32 thus exposed, and then the ADF 400 is closed to press the documents against the contact glass 32.

After the documents are placed either on the document stand 30 or the contact glass 32, a start switch, not shown, is pressed to start image reading by the scanner 300. It should be noted that in a case in which the documents are placed on the document stand 30, the documents are automatically conveyed to the contact glass 32 by the ADF 400 before the scanner 300 starts image reading. When image reading is started, a first carriage 33 and a second carriage 34 start scanning, and light is directed from a light source provided to the first carriage 33 to the documents. The light reflected from the documents is further reflected by a mirror provided inside the second carriage 34, and passes through an imaging lens 35 to enter a reading sensor 36. The reading sensor 36 forms image data based on the light thus entered.

Meanwhile, operation of the process cartridges 18, the intermediate transfer unit 17, the secondary transfer device 22, and the fixing device 25 is started. The optical writing unit 21 is controlled based on the image data formed by the reading sensor 36 to form the toner images of yellow, magenta, cyan, and black on the photoconductors 1Y, 1M, 1C, and 1K, respectively. The toner images thus formed are sequentially transferred onto the intermediate transfer belt 110 to form the full-color toner image.

Substantially at the same time when image reading is started, paper feeding is started in the paper feeder 200. In the paper feeder 200, one of the multiple paper feed rollers 42 is selectively rotated to convey the transfer sheet from one of the multiple paper feed cassettes 44 set in a paper bank 43. The transfer sheet thus conveyed is separated sheet by sheet by one of pairs of separation rollers 45 to be conveyed to the paper feed path 46. Thereafter, the transfer sheet is conveyed to the secondary transfer nip by the pair of conveyance rollers 47. In place of the paper feed cassette 44, the transfer sheet may be fed from a manual paper feed tray 51. In a case in which the transfer sheet is fed from the manual paper feed tray 51, a manual paper feed roller 50 is rotated to convey the transfer sheet placed on the manual paper feed tray 51. Thereafter, the separation roller 52 separates the transfer sheet one by one to convey the transfer sheet to a manual paper feed path 53 in the printer 100.

In a case in which a multi-color image is formed using two or more colors of toner, an upper stretched surface of the intermediate transfer belt 110 is horizontally stretched such that the photoconductors 1 contact the upper stretched surface of the intermediate transfer belt 110. By contrast, in a case in which a monochrome image is formed using black toner, the intermediate transfer belt 110 is tilted to the lower left in FIG. 1 by a mechanism, not shown, such that the upper stretched surface of the intermediate transfer belt 110 is removed from the photoconductors 1Y, 1M, and 1C. Thereafter, the photoconductor 1K is rotated in a counterclockwise direction in FIG. 1 to form a black toner image. At this time, not only the photoconductors 1Y, 1M, and 1C but also the developing devices 4Y, 4M, and 4C are not operated to prevent unnecessary consumption of toner and wearing out of parts provided to the photoconductors 1Y, 1M, and 1C and the developing devices 4Y, 4M, and 4C.

The image forming apparatus 500 further includes a control unit, not shown, including a CPU to control each unit in the image forming apparatus 500, and a control panel, not shown, including a liquid crystal display, keys, buttons, and so forth. A user sends instructions to the control unit through the keys provided on the control panel to select one of three printing modes for simplex printing. Simplex printing is used for forming an image only on one side of the transfer sheet, and includes the three printing modes such as a direct discharge mode, a reverse discharge mode, and a reverse decor discharge mode.

Figure 2:
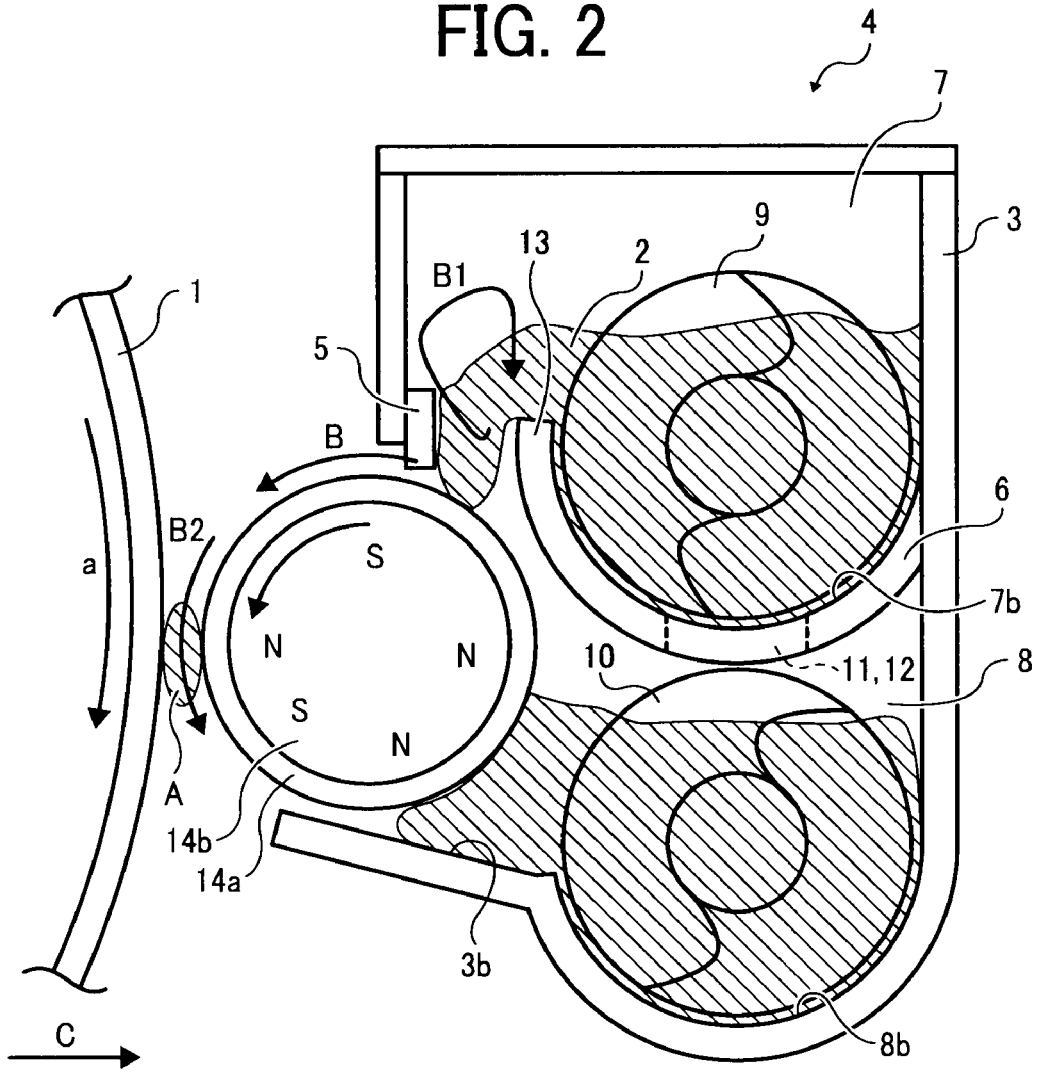
FIG. 2 is an enlarged schematic view illustrating a developing device according to illustrative embodiments.

FIG. 2 is an enlarged schematic view illustrating the developing device 4 and the photoconductor 1 included in one of the process cartridges 18 viewed from the back side of the image forming apparatus 500 illustrated in FIG. 1. Each of the four process cartridges 18 has substantially the same configuration except that toner of a different color is used therein. Therefore, letters Y, M, C, and K indicating the color of toner suffixed to the developing device 4 are hereinafter omitted.

The developing device 4 is provided opposite the photoconductor 1 serving as a latent image bearing member. The photoconductor 1 is rotated in a clockwise direction as indicated by an arrow a in FIG. 2. While the photoconductor 1 is rotated, the surface of the photoconductor 1 is charged by the charger, not shown. The optical writing unit 21 serving as an exposure device directs laser light to the charged surface of the photoconductor 1 to form an electrostatic latent image thereon.

A developer container 3 serving as a casing of the developing device 4 stores developer 2. The developer 2 is powder, and includes two components: a magnetic carrier and magnetic or nonmagnetic toner. The developing device 4 includes a developing sleeve 14*a* serving as a developer bearing member to bear the developer 2 on a surface thereof to convey the developer 2 in the developer container 3 to a developing area A. At the developing area A, the toner is supplied to the electrostatic latent image formed on the surface of the photoconductor 1 to develop the electrostatic latent image with the toner. Inside the developing sleeve 14*a* is a magnet roller 14*b* including multiple magnets fixed with respect to the developing device 4. The developing device 4 further includes a restriction member 5 to restrict a thickness of the developer 2 borne on the surface of the developing sleeve 14*a*.

In the developing device 4 are two substantially parallel screws, a supply screw 9 and a recovery screw 10, each serving as a conveyance screw for conveying the developer 2 in an axial direction of the developing sleeve 14*a*. Each of the supply screw 9 and the recovery screw 10 includes a rotary axis and a blade extending spirally along a length of the rotary axis, and is rotated to convey the developer 2 in a given direction along the axis of the rotary axis thereof. An interior of the developer container 3 is divided by inner walls and a partition 6. Specifically, a supply path 7 and a recovery path 8 each serving as a developer path are formed one above the other with the partition 6 therebetween, and the developer 2 is stored in the developer path. The partition 6 includes an opening on each end on front and back sides thereof in FIG. 2 so that the supply path 7 and the recovery path 8 communicate via the two openings, respectively. As illustrated in FIG. 2, the supply path 7 is positioned next to the developing sleeve 14*a* with a wall 13 therebetween, and the recovery path 8 is positioned next to the supply path 7 with the partition 6 therebetween.

The supply screw 9 and the recovery screw 10 are disposed in the supply path 7 and the recovery path 8, respectively. The developer 2 in the developer container 3 is stored in the supply path 7 and the recovery path 8. The recovery screw 10 is arranged substantially in parallel to the supply screw 9, and the developer 2 in the recovery path 8 is conveyed by the recovery screw 10 in a direction opposite a direction of conveyance of the developer 2 conveyed by the supply screw 9 in the supply path 7.

As the supply screw 9 and the recovery screw 10 rotate, the developer 2 in the developer container 3 is circulated between the supply path 7 and the recovery path 8 through the two openings respectively provided on the ends of the partition 6.

The developer 2 stored in the supply path 7 is conveyed by rotation of the supply screw 9 to be supplied to the surface of the developing sleeve 14*a*. The developer 2 passes over the wall 13 by rotation of the supply screw 9 and is attracted to the developing sleeve 14*a* due to a magnetic force from the magnet roller 14*b* provided in the developing sleeve 14*a*. Accordingly, the developer 2 is supplied from the supply path 7 to the developing sleeve 14*a*.

The developer 2 thus supplied to the developing sleeve 14*a* is borne by the developing sleeve 14*a* and conveyed in a direction indicated by an arrow B in FIG. 2 due to rotation of the developing sleeve 14*a* and the magnetic force from the magnet roller 14*b*. When the developer 2 borne on the surface of the developing sleeve 14*a* passes the restriction member 5 as indicated by the arrow B in FIG. 2, an excess amount of the developer 2 is removed from the surface of the developing sleeve 14*a* as indicated by an arrow B1 in FIG. 2.

The developer 2 passing through the restriction member 5 further passes through the developing area A formed between the developing sleeve 14*a* and the photoconductor 1 as indicated by an arrow B2 in FIG. 2. Thereafter, the developer 2 is removed from the developing sleeve 14*a*, and flows downward to a bottom portion 3*b* of the developer container 3 and is conveyed to the recovery path 8.

Specifically, any developer 2 remaining on the developing sleeve 14*a* without being supplied to the surface of the photoconductor 1 at the developing area A is not directly returned to the supply path 7 by rotation of the developing sleeve 14*a*. Instead, such developer 2 is first returned to the recovery path 8 after passing the developing area A. As a result, developer 2 that is already sufficiently agitated while in the recovery path 8 is then returned to the supply path 7.

The developer 2 conveyed to a downstream end of the supply path 7 and the developer 2 removed from the developing sleeve 14*a* after passing through the developing area A is returned to an upstream end of the supply path 7 through the recovery path 8. Because toner density of the developer 2 conveyed to the recovery path 8 after passing through the developing area A is decreased, new toner needs to be supplied to the developer 2. This new toner is supplied to the developer 2 in the recovery path 8 based on an amount of toner consumed for development obtained by latent image data, or a measurement result of the toner density of the developer 2 in the recovery path 8. As a result, the developer 2 having appropriate toner density is conveyed from the recovery path 8 to the supply path 7.

Recent developments in full-color printing have resulted in increased demand for document printing with a higher coverage rate, such as photographs, compared with documents with a lower coverage rate. In a developing device in which a developer supplied to a developing sleeve from a supply path is directly returned to the supply path after passing through a developing area, a density distribution of toner in the developer becomes uneven because more of toner is consumed when documents with a higher coverage rate are printed. As a result, uneven image density may occur within a same printed page, or between printed pages.

By contrast, in the developing device 4 according to illustrative embodiments described herein, the developer 2 remaining on the developing sleeve 14*a* after passing through the developing area A is not directly returned to the supply path 7 along with rotation of the developing sleeve 14*a*. Instead, such developer 2 is first conveyed to the recovery path 8, and then conveyed to the supply path 7. Accordingly, only that developer 2 which is already sufficiently agitated in the recovery path 8 ends up in the supply path 7. As a result, the developer 2 having a uniform toner density is consistently supplied to the developing sleeve 14*a*, providing higher-quality images without either color irregularity in a thrust direction or density difference, both of which are caused by insufficient agitation of the developer.

Further, in the developing device 4 in which the supply screw 9 and the recovery screw 10 are arranged one above the other as described above, the supply path 7 and the recovery path 8 are disposed substantially parallel to each other and one above the other, so that an installation space for the developer path in a horizontal direction can be reduced. As a result, a tandem-type full-color image forming apparatus such as the image forming apparatus 500, in which multiple developing devices are disposed parallel to one another in a horizontal direction, can be downsized.

Figure 3:
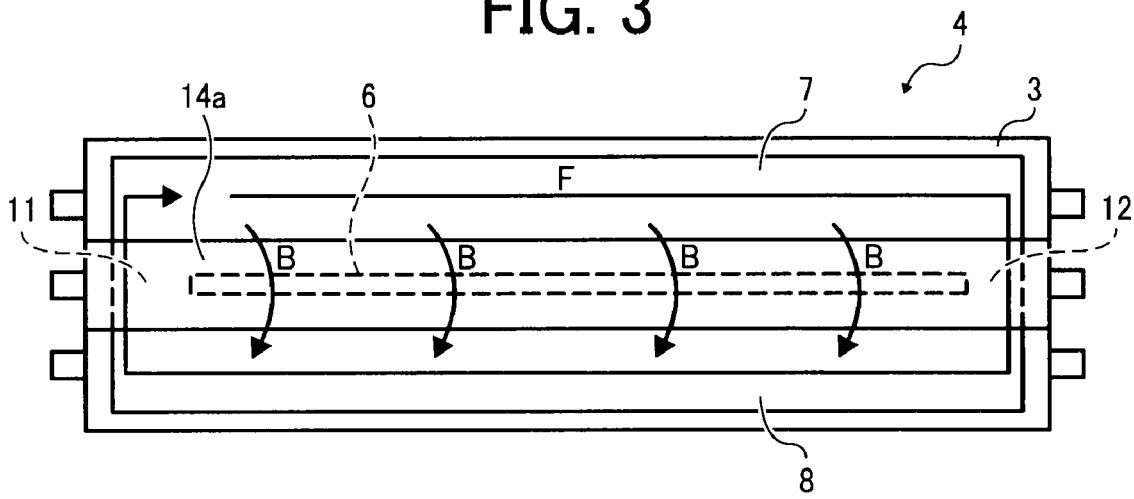
FIG. 3 is a side view illustrating a flow of developer in a developer container.

FIG. 3 is a side view illustrating a flow of the developer 2 in the developing container 3 of the developing device 4 as viewed from a direction indicated by an arrow C in FIG. 2. An arrow F in FIG. 3 indicates a flow of the developer 2 in the developer container 3. As described above in FIG. 2, the developer 2 supplied to the developing sleeve 14*a* is borne by the developing sleeve 14*a* and conveyed in a direction indicated by the arrows B in FIG. 3.

As is clear from FIGS. 2 and 3, the supply path 7 and the recovery path 8 are arranged one above the other in a vertical direction in the developing device 4. At a downside opening 12, which is one of the two openings provided at the ends of the partition 6 and illustrated in the right of the FIG. 3, the developer 2 is moved from up to down to be conveyed from the downstream end of the supply path 7 to the upstream end of the recovery path 8. By contrast, at an upside opening 11, which is the other one of the two openings provided at the ends of the partition 6 and illustrated in the left of the FIG. 3, the developer 2 is moved from down to up to be conveyed from the downstream end of the recovery path 8 to the upstream end of the supply path 7. The developer 2 is moved upward from the recovery path 8 to the supply path 7 at the upside opening 11 by pressure of the developer 2 accumulated at the downstream end of the recovery path 8 relative to a direction of conveyance of the developer 2.

In the developing device 4, not all the developer 2 conveyed from the recovery path 8 to the supply path 7 is conveyed by the supply screw 9 to the downstream end of the supply path 7 relative to the direction of conveyance of the developer 2. As indicated by the arrows B in FIG. 3, only part of the developer 2 is supplied to the surface of the developing sleeve 14*a* while being conveyed in the supply path 7. The developer 2 is supplied across the entire width of the surface of the developing sleeve 14*a* in the axial direction thereof. After passing through the developing area A, such developer 2 is returned to the recovery path 8.

Therefore, an amount of the developer 2 conveyed by the supply screw 9 in the supply path 7 is gradually reduced from the upstream end to the downstream end of the supply path 7 relative to the direction of conveyance of the developer 2.

By contrast, an amount of the developer 2 conveyed by the recovery screw 10 in the recovery path 8 is gradually increased from the upstream end to the downstream end in the recovery path 8 relative to the direction of conveyance of the developer 2. In other words, a distribution of the developer 2 in the developing device 4 is not even.

Figure 4:
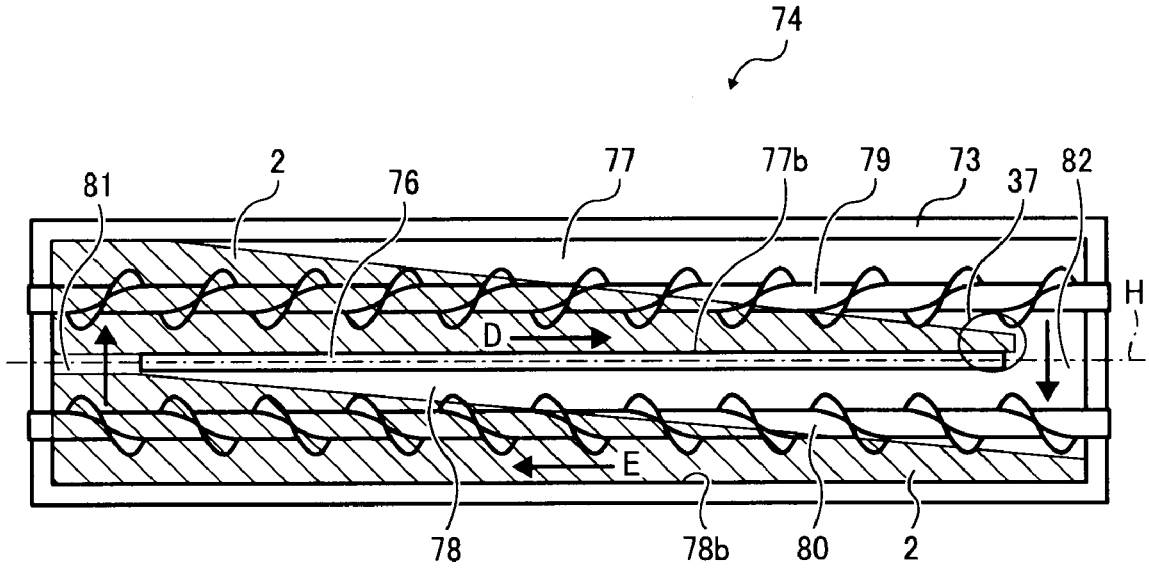
FIG. 4 RELATED ART
FIG. 4 is a view illustrating a distribution of developer in a supply path and a recovery path in a related-art developing device.
Figure 5:
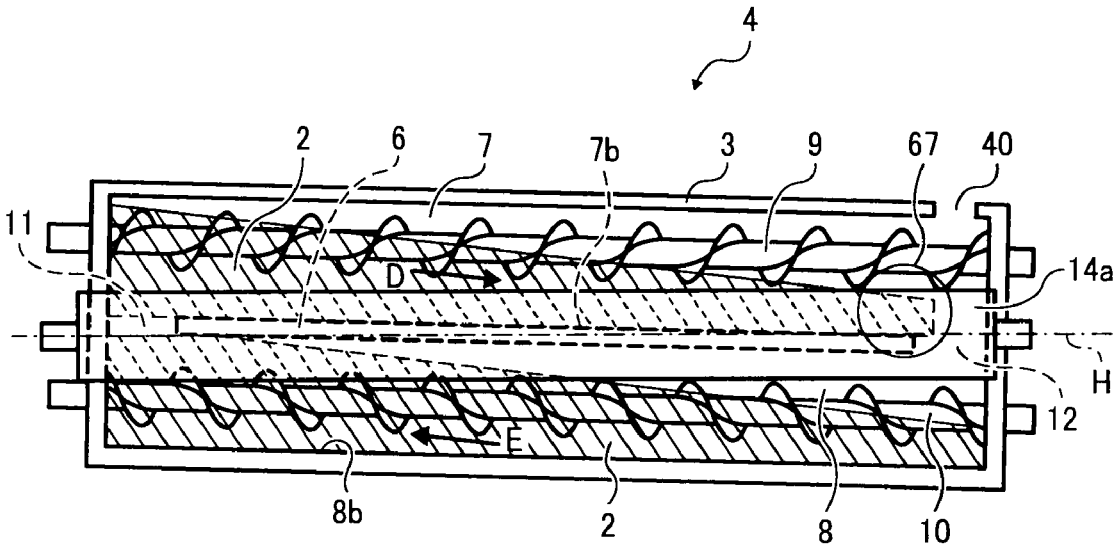
FIG. 5 is a view illustrating a supply path and a recovery path in a developing device according to a first illustrative embodiment.
Figure 6:
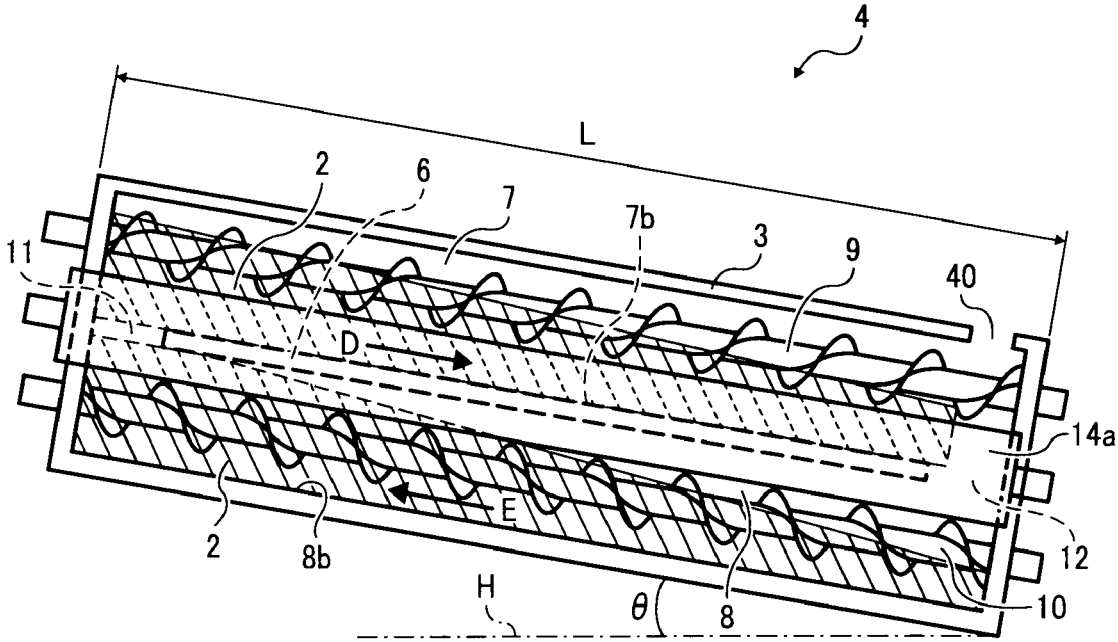
FIG. 6 is a view illustrating a supply path and a recovery path in a developing device according to a second illustrative embodiment.

FIG. 4 is a view illustrating a distribution of the developer 2 in a supply path 77 and a recovery path 78 in a developing container 73 of a related-art developing device 74. The distribution of the developer 2 in the related-art developing device 74 is indicated by shaded areas in FIG. 4. Reference numeral 76 denotes a partition provided between the supply path 77 and the recovery path 78. Although in FIG. 4 a supply screw 79 and a recovery screw 80 are arranged apart from a bottom surface 77*b* of the supply path 77 and a bottom surface 78*b* of the recovery path 78, respectively, the screws 79 and 80 are actually arranged such that bottom edges of blades of the screws 79 and 80 are positioned close to the bottom surface 77*b* and the bottom surface 78*b*, respectively, in a similar manner as in the case of FIG. 2. It should be noted that shaded areas in FIGS. 5 and 6 to be described in detail later also indicate the distribution of the developer 2, and the supply screw 9 and the recovery screw 10 in FIGS. 5 and 6 are arranged in a similar manner as the supply screw 79 and the recovery screw 80 in the developing device 74 illustrated in FIG. 4.

As illustrated in FIG. 4, the supply screw 79 is arranged such that a rotary axis thereof is parallel to a horizontal axis H in the related-art developing device 74, so that the developer 2 is conveyed by the supply screw 79 in a horizontal direction in the supply path 77. Further, the recovery screw 80 is arranged such that a rotary axis thereof is parallel to the horizontal axis H, so that the developer 2 is conveyed by the recovery screw 80 in a horizontal direction in the recovery path 78. Here, the horizontal direction means a direction perpendicular to a vertical direction, and the horizontal axis H is a virtual axis having an axial direction in a horizontal direction.

As described above, in the related-art developing device 74, the amount of the developer 2 is gradually reduced from the upstream end to the downstream end in the supply path 77 in the direction of conveyance of the developer 2. Consequently, the amount of the developer 2 becomes smaller on a farther downstream side of the supply path 77 relative to the direction of conveyance of the developer 2. When the amount of the developer 2 is uneven at the upstream end and the downstream end in the supply path 77 relative to the direction of conveyance of the developer 2 as illustrated in FIG. 4, the developer 2 is not evenly supplied to a developing sleeve. Specifically, the amount of the developer 2 supplied to the developing sleeve is uneven in an axial direction of the developing sleeve.

The uneven amount of the developer 2 supplied to the developing sleeve causes uneven image density in images in the axial direction of the developing sleeve. Specifically, on the upstream side in the supply path 77 relative to the direction of conveyance of the developer 2 to where a sufficient amount of the developer 2 is conveyed, the developer 2 is evenly supplied to the developing sleeve, resulting in an even image density. By contrast, on the downstream side in the supply path 77 relative to the direction of conveyance of the developer 2 to where a smaller amount of the developer 2 is conveyed, the developer 2 is not evenly supplied to the developing sleeve. Consequently, an uneven image density occurs in images formed at a portion 37 located close to the downstream end of the supply path 77.

Further, in the developing device 74 in which the recovery path 78 is arranged below the supply path 77 in a vertical direction, the developer 2 is conveyed downward from the supply path 77 to the recovery path 78 at a downside opening 82, and then conveyed upward from the recovery path 78 to the supply path 77 at an upside opening 81. As described above, the developer 2 is moved upward from the recovery path 78 to the supply path 77 at the upside opening 81 by pressure of the developer 2 accumulated at the downstream end of the recovery path 78 relative to the direction of conveyance of the developer 2. When the developer 2 is conveyed in the horizontal direction by the recovery screw 80 as illustrated in FIG. 4, a force for moving the developer 2 upward is not applied to the developer 2 at the upside opening 81. Consequently, the developer 2 is not effectively conveyed from the recovery path 78 to the supply path 77 at the upside opening 81, causing clogging of the developer 2 at the upside opening 81.

Examples of possible solutions for the problem of unevenness in the amount of the developer in the developer path include the developing device disclosed in JP-A-H05-333691. As described above, in the developing device disclosed in JP-A-H05-333691, rotation speed of the supply screw and the recovery screw is increased so that a sufficiently larger amount of the developer is conveyed in the supply path and the recovery path compared with the amount of the developer supplied to the developing sleeve. As a result, unevenness in the amount of the developer at the upstream end and the downstream end in the supply path is reduced. However, faster rotation speed of the screws causes larger stress to the developer, resulting in deterioration in the developer. Further, the faster rotation speed of the screws also causes an increase in torque, causing abrasion of mechanical components such as roller bearings. In other words, there is a limit to how much the rotation speed of the screws can be increased, imposed by the need to prevent shortening the life of the developing device and the developer.

Another approach is disclosed in JP-A-2002-006599, in which a mechanism for causing the developer to stay at the downstream end of the supply path is provided to reduce unevenness in the amount of the developer at the upstream end and the downstream end in the supply path. Because the developer stays at the downstream end of the supply path due to the mechanism, an amount of the developer at the downstream end of the supply path is increased. However, a technique for adjusting an amount of the developer at a middle portion of the supply path is not disclosed in JP-A-2002-

006599. Consequently, unevenness in the amount of the developer still occurs in the supply path, causing unevenness in image density.

To solve the problem of clogging of the developer 2 at the upside opening 81, JP-A-2002-236420 discloses a developing device in which a developer elevation means is provided at an upside opening for conveying the developer upward from a recovery path to a supply path. As a result, the developer is effectively conveyed from the recovery path to the supply path, preventing clogging of the developer at the upside opening. However, upsizing of the developing device is required to provide the developer elevation means at the upside opening.

Another approach is disclosed in JP-A-2004-133339, in which a recovery screw is tilted upward relative to a direction of conveyance of the developer. In the developing device 74 in which the developer 2 is conveyed from the recovery path 78 to the supply path 77 only by pressure, a force for conveying the developer 2 upward is not applied to the developer 2. By contrast, in the developing device disclosed in JP-A-2004-133339, a force generated by rotation of the conveyance screw conveys the developer upward so that the developer is elevated to the supply path while being conveyed by the conveyance screw. Accordingly, the developer is effectively conveyed from the recovery path to the supply path. However, when the supply path and the recovery path are horizontally arranged at the upside opening in the developing device as disclosed in JP-A-2004-133339, a width of the developing device needs to be increased. Alternatively, although the width of the developing device is reduced when the recovery path is arranged directly below the supply path in a vertical direction, a distance between axes of the supply screw and the recovery screw is narrowed, resulting in a complex configuration.

To solve the above-described problems, the developing device 4 according to illustrative embodiments is provided, and a description thereof is provided in detail below.

A description is now given of the developing device 4 according to a first illustrative embodiment. FIG. 5 is a view illustrating the developing device 4 including the developing sleeve 14*a*, the supply path 7, the recovery path 8, and so forth, viewed from the direction indicated by the arrow C in FIG. 2. As described above, the shaded areas in FIG. 5 indicate the distribution of the developer 2.

Referring to FIG. 5, in the developing device 4 according to the first illustrative embodiment, the developer container 3 and the partition 6 each forming the supply path 7 and the recovery path 8 are tilted relative to the horizontal axis H. Specifically, a bottom surface 7*b* of the supply path 7 is tilted such that the bottom surface 7*b* at the downstream end of the supply path 7 relative to the direction of conveyance of the developer 2 is lower than the upstream end, and a bottom surface 8*b* of the recovery path 8 is tilted such that the bottom surface 8*b* at the downstream end of the recovery path 8 relative to the direction of conveyance of the developer 2 is higher than the upstream end. Further, the supply screw 9 is arranged such that the rotary axis thereof is parallel to the bottom surface 7*b*, and the recovery screw 10 is arranged such that the rotary axis thereof is parallel to the bottom surface 8*b*. Because the bottom surfaces 7*b* and 8*b* are tilted at the same angle relative to the horizontal axis H, the bottom surfaces 7*b* and 8*b* are parallel to each other, and the rotary axes of the supply screw 9 and the recovery screw 10 are also parallel to each other.

As described above, in the developing device 4 according to the first illustrative embodiment, the bottom surface 7*b* of the supply path 7 is tilted relative to the horizontal axis H such that the bottom surface 7*b* at the downstream end of the supply path 7 relative to the direction of conveyance of the developer 2 is lower than the bottom surface 7*b* at the upstream end of the supply path 7. Accordingly, the direction of conveyance of the developer 2 in the supply path 7 indicated by an arrow D in FIG. 5 declines. Further, the bottom surface 8*b* of the recovery path 8 is tilted relative to the horizontal axis H such that the bottom surface 8*b* at the downstream end of the recovery path 8 relative to the direction of conveyance of the developer 2 is higher than the bottom surface 8*b* at the upstream end of the recovery path 8. Accordingly, the direction of conveyance of the developer 2 in the recovery path 8 indicated by an arrow E in FIG. 5 is elevated. The developing device 4 having the above-described configuration can reduce unevenness in the amount of the developer 2 in the developer path compared with the related-art developing device 74 illustrated in FIG. 4.

As described above, in the related-art developing device 74, the amount of the developer 2 at the portion 37 close to the downstream end of the supply path 77 is reduced, and clogging of the developer 2 is likely to occur at the upside opening 81 provided at the downstream end of the recovery path 78.

By contrast, in the developing device 4 according to the first illustrative embodiment, the bottom surface 7*b* of the supply path 7 is tilted relative to the horizontal axis H, thus enlisting gravity to increase the conveyance speed of the developer 2 in the supply path 7 without increasing the rotation speed of the supply screw 9. Further, the increase in the conveyance speed of the developer 2 in the supply path 7 increases the amount of the developer 2 conveyed in the supply path 7. Accordingly, the amount of the developer 2 at a portion 67 close to the downstream end of the supply path 7 can be increased compared with the related-art developing device 74. As a result, because the amount of the developer 2 conveyed in the supply path 7 can be increased without increasing the rotation speed of the supply screw 9, unevenness in the amount of the developer 2 in the supply path 7 in the direction of conveyance of the developer 2 can be reduced with less stress to the developer 2.

Further, because the bottom surface 8*b* is tilted relative to the horizontal axis H such that the direction of conveyance of the developer 2 is elevated in the recovery path 8 as described above, the following effects can be obtained. Specifically, because the direction of conveyance of the developer 2 is tilted upward in the recovery path 8, a force is applied to the developer 2 in the horizontal and vertically upward directions. Accordingly, although the conveyance speed of the developer 2 in the horizontal direction is slightly reduced in the recovery path 8 compared with the related-art developing device 4 illustrated in FIG. 4, in which the developer 2 is conveyed only in the horizontal direction in the recovery path 78, the developer 2 is conveyed in the vertically upward direction as well as the horizontal direction in the recovery path 8 of the developing device 4 according to the first illustrative embodiment. Specifically, the developer 2 in the recovery path 8 is conveyed upward against gravity due to the vertically upward force generated by rotation of the recovery screw 10 even when the distance between the bottom surfaces 7*b* and 8*b* and the distance between the rotary axes of the supply screw 9 and the recovery screw 10 are the same as those of the related-art developing device 74. As a result, the developer 2 is effectively conveyed upward from the recovery path 8 to the supply path 7 at the upside opening 11 provided at the downstream end of the recovery path 8 in the developing device 4 according to the first illustrative embodiment.

Although the conveyance speed of the developer 2 in the horizontal direction is reduced in the recovery path 8 as described above, nevertheless the developer 2 is smoothly conveyed from the recovery path 8 to the supply path 7 at the upside opening 11 so that clogging of the developer 2 at the upside opening 11 can be prevented.

Further, when the tilt angle of the bottom surface 8*b* relative to the horizontal axis H is increased, gravity moves a portion of the developer 2 in the recovery path 8 in the direction opposite the direction of conveyance of the developer 2 achieved by rotation of the recovery screw 10. Such a phenomenon tends to occur at a portion close to the downstream end of the recovery path 8 relative to the direction of conveyance of the developer 2, where an accumulation of the developer 2 exceeds the height of the blade of the recovery screw 10. Although rotation of the blade of the recovery screw 10 can convey the developer 2 in a direction against gravity, the developer 2 above the blade of the recovery screw 10 is likely to be conveyed in the direction opposite the direction of conveyance of the developer 2 due to gravity.

Because clogging of the developer 2 occurs at the portion near the downstream end of the recovery path 8, the developer 2 at that portion tends to be conveyed in the direction opposite the direction of conveyance of the developer 2 due to gravity. Consequently, an excess amount of the developer 2 at the portion near the downstream end of the recovery path 8 is returned to the upstream side of the recovery screw 10 relative to the direction of conveyance of the developer 2, where the amount of the developer 2 is smaller, due to gravity. As a result, unevenness in the amount of the developer 2 in the recovery path 8 is reduced. Further, because the developer 2 is circulated in the recovery path 8 due to gravity as described above, the developer 2 is effectively agitated in the recovery path 8, resulting in reduction of an amount of the developer 2 that is not sufficiently agitated.

Accordingly, another advantage of the developing device 4 according to the first illustrative embodiment, in which the supply path 7 and the recovery path 8 are arranged one above the other, is that occurrence of irregularity in images caused by insufficient agitation of the developer 2 supplied with the toner can be reduced. A description is now given of such an advantage in detail.

In the developing device 4 according to the first illustrative embodiment, the toner is supplied to the developer 2 in the recovery path 8 based on measurements of toner density of the developer 2 in the recovery path 8. As illustrated in FIG. 5, the developing device 4 includes a toner supply opening 40 above the downside opening 12. The toner supplied from the toner supply opening 40 falls due to gravity and is supplied to the developer 2 in the recovery path 8 through the downside opening 12.

In an ordinary developing device, when toner density of developer is reduced, toner is supplied to the developer in the developing device from a toner supply device provided outside of the developing device. The toner is dropped from an upper portion of a developer path onto the top of the developer in the developer path. The toner thus supplied is agitated to be mixed into the developer in the developer path by rotation of a conveyance screw. However, because there is a difference in fluidity between the developer and the toner, the toner supplied on the top of the developer tends to remain there. Consequently, the developer is not sufficiently agitated.

In the developing device disclosed in the JP-A-2004-133339, the recovery path and the supply path are arranged such that the height of the downstream end of the recovery path relative to the direction of conveyance of the developer is the same as that of the upstream end of the supply path relative to the direction of conveyance of the developer. Accordingly, the developer is vertically conveyed from the recovery path to the supply path. As a result, although the developer is effectively conveyed from the recovery path to the supply path, the developer is not sufficiently mixed with the toner while being conveyed.

By contrast, in the developing device 4 according to the first illustrative embodiment, in which the supply path 7 and the recovery path 8 are arranged one above the other, the developer 2 conveyed from the recovery path 8 to the supply path 7 is supplied to the bottom of the developer 2 in the supply path 7 at the upside opening 11. Accordingly, even when the developer 2 having the toner on the top thereof reaches the downstream end of the recovery path 8 relative to the direction of conveyance of the developer 2, the toner is mixed with the developer 2 when the developer 2 is conveyed from the recovery path 8 to the supply path 7 at the upside opening 11. As a result, the toner and the developer 2 are effectively agitated, so that occurrence of irregularity in images caused by insufficient agitation of the developer 2 can be reduced.

Further, because the supply path 7 and the recovery path 8 are arranged one above the other, the developing device 4 can be downsized in the horizontal direction.

In the developing device 4 according to the first illustrative embodiment, in which the developer 2 is circulated only one way in the developing device 4, amounts of the developer 2 stored in the supply path 7 and the recovery path 8 respectively are determined by relatives speed of the developer 2 conveyed by the supply screw 9 and the recovery screw 10. Specifically, when the speed of the developer 2 conveyed by the supply screw 9 is faster than that of the developer 2 conveyed by the recovery screw 10, more of the developer 2 is stored in the recovery path 8 compared with the amount of the developer 2 stored in the supply path 7. By contrast, when the speed of the developer 2 conveyed by the supply screw 9 is slower than that of the developer 2 conveyed by the recovery screw 10, more of the developer 2 is stored in the supply path 7 compared with the amount of the developer 2 stored in the recovery path 8.

A description is now given of the conveyance speed of the developer 2 before and after passing through the upside opening 11 in the developing device 4. Because the developer 2 is conveyed upward against gravity in the recovery path 8, the conveyance speed of the developer 2 therein is slower. By contrast, because the developer 2 is conveyed downward with gravity in the supply path 7, the conveyance speed of the developer 2 therein is faster.

In a case in which the conveyance speed of the developer 2 before passing through the upside opening 11 is relatively faster than that after passing through the upside opening 11, circulation of the developer 2 is disturbed at the upside opening 11 because the speed of the developer 2 conveyed to the downstream side of the supply path 7 after passing through the upside opening 11 is slower. To solve such a problem, the conveyance speed of the developer 2 after passing though the upside opening 11 is required to be increased.

In the developing device 4 according to the first illustrative embodiment, the bottom surfaces 7*b* and 8*b*, the supply screw 9, and the recovery screw 10 are tilted so that clogging of the developer 2 at the upside opening 11 can be further reduced without adjusting the rotation speed of the supply screw 9 and the recovery screw 10.

Further, because the two paths 7 and 8 are tilted as described above, the conveyance speed of the developer 2 is faster in the supply path 7 compared with the conveyance speed of the developer 2 in the recovery path 8. Accordingly, more of the developer 2 is stored in the recovery path 8 compared with an amount of the developer 2 stored in the supply path 7.

When the toner is supplied to the developing device 4 to compensate for the toner consumed by development, preferably more of the developer 2 is stored near the toner supply opening 40 because it is difficult to convey the toner by the screws 9 and 10 due to higher fluidity of the toner. Consequently, the toner is not mixed with the developer 2, and the toner density is not increased. In a case in which a sufficient amount of the developer 2 is not present near the toner supply opening 40 when the toner is supplied to the developer 2, the amount of the toner is in excess relative to an amount of carriers present near the toner supply opening 40, causing toner scattering even outside the developing device 4. Therefore, a sufficient amount of the developer 2 needs to be present near the toner supply opening 40 in order to effectively mix the toner with the developer 2.

As described above, the conveyance speed of the developer 2 is faster in the supply path 7 than in the recovery path 8 due to gravity. As a result, more of the developer 2 tends to be stored in the recovery path 8 in the developing device 4. In other words, a sufficient amount of the developer 2 is present near the toner supply opening 40. Accordingly, the toner supplied from the toner supply opening 40 is preferably mixed with the developer 2 in the developing device 4, preventing insufficient agitation of the toner and the developer 2.

As described above, in the developing device 4 according to the first illustrative embodiment, the bottom surface 7*b* is tilted such that the bottom surface 7*b* at the downstream end of the supply path 7 relative to the direction of conveyance of the developer 2 is lower than the bottom surface 7*b* at the upstream end of the supply path 7, and the bottom surface 8*b* is tilted such that the bottom surface 8*b* at the downstream end of the recovery path 8 relative to the direction of conveyance of the developer 2 is higher than the bottom surface 8*b* at the upstream end of the recovery path 8. Further, the supply path 7 and the recovery path 8 are arranged one above the other in the vertical direction. As a result, the developing device 4 can be downsized, and unevenness in the amount of the developer 2 in the developer path can be reduced without applying excess stress to the developer 2 and the developing device 4, providing higher-quality images. In addition, the toner is sufficiently mixed with the developer 2.

Further, clogging of the developer 2 at the upside opening 11 can be reduced. As a result, stress applied to the developer 2 at the upside opening 11 can be reduced, preventing deterioration in the developer 2 and extending the life of the developer 2.

A description is now given of the developing device 4 according to a second illustrative embodiment.

FIG. 6 is a view illustrating the developing device 4 according to the second illustrative embodiment, viewed from the direction indicated by the arrow C in FIG. 2. As in FIGS. 4 and 5, the shaded areas in FIG. 6 indicate the distribution of the developer 2.

In the developing device 4 according to the second illustrative embodiment, the developer container 3 and the partition 6 are tilted relative to the horizontal axis H, and the bottom surfaces 7*b* and 8*b*, the supply screw 9, and the recovery screw 10 are tilted relative to the horizontal axis H in a similar manner as the developing device 4 according to the first illustrative embodiment. A difference between the first illustrative embodiment and the present second illustrative embodiment is that the developing sleeve 14*a* is also tilted relative to the horizontal axis H in the second illustrative embodiment. Specifically, in the developing device 4 according to the second illustrative embodiment, the rotary axis of the developing sleeve 14*a* is parallel to the rotary axis of the supply screw 9.

A configuration of the developing device 4 according to the second illustrative embodiment is identical to that of the developing device 4 according to the first illustrative embodiment except that the developing sleeve 14*a* is tilted relative to the horizontal axis H. The configuration identical to that of the first illustrative embodiment provides the same advantages and effects provided by the developing device 4 according to the first illustrative embodiment.

Because the bottom surface 7*b* of the supply path 7 is tilted as described above in the developing device 4 according to the second illustrative embodiment, the developer 2 in the supply path 7 is conveyed also by gravity so that the amount of the developer 2 conveyed in the supply path 7 is increased. Specifically, the same effect achieved by increasing the rotation speed of the supply screw 9 can be provided without increasing stress to the developer 2 and the developing device 4.

Although stress to the developer 2 is increased, the amount of the developer 2 conveyed in the supply path 77 can be increased even in the related-art developing device 74 illustrated in FIG. 4 by increasing the rotation speed of the supply screw 79, preventing a decrease in the amount of the developer 2 in the supply path 77. As a result, a top surface of the developer 2 in the supply path 77 is equalized relative to the rotary axis of the supply screw 79.

In addition, when the rotary axis of the developing sleeve is parallel to the rotary axis of the supply screw 79 similar to the second illustrative embodiment, a distance between the top surface of the developer 2 in the supply path 77 and the developing sleeve is also equalized. As a result, the developer 2 can be more reliably supplied to the developing sleeve in the related-art developing device 74.

A width of the image forming apparatus 500 can be downsized by employing the developing device 4 according to the second illustrative embodiment. Specifically, because the developing sleeve 14*a* is tilted in the axial direction thereof, the photoconductor 1 provided opposite the developing device 4 is also tilted along with the developing sleeve 14*a*. In addition, the intermediate transfer belt 110 and the fixing device 25 are tilted along with the photoconductor 1. In such a configuration, because an optical length from an irradiation point of the optical writing unit 21 to the photoconductor 1 is different depending on a tilt angle of the photoconductor 1 when the laser light is directed from the optical writing unit 21 to the photoconductor 1, it is desired to provide a mechanism for correcting the optical length so that it remains unchanged.

When a tilt angle of the developing device 4 relative to the horizontal axis H is represented by $\theta$, and a length of the developing device 4 in a longitudinal direction is represented by L [m], the width of the developing device 4 in the longitudinal direction can be reduced by $L(1-\cos\theta)$ [m] in the image forming apparatus 500.

When an ordinary developing device is employed, the developer is unevenly stored in the developing device when the developing device is tilted. Consequently, the developer is not reliably supplied to the developing sleeve. By contrast, when the developing device 4 according to the second illustrative embodiment is employed, the developing device 4 is tilted so that the developer 2 is reliably supplied to the developing sleeve 14*a*, and the image forming apparatus 500 can be downsized.

A description is now given of an experiment in which the tilt angle $\theta$ of the developing device 4 according to the second illustrative embodiment relative to the horizontal axis H is changed. It should be noted that each of the supply screw 9 and the recovery screw 10 has a screw diameter of ϕ12 [mm], a screw shaft diameter of ϕ5 [mm], and a screw pitch of 12.5 [mm]. When the tilt angle θ of the developing device 4 relative to the horizontal axis H is 0°, the rotation speed of each of the supply screw 9 and the recovery screw 10 is set to 1200 [rpm].

Developer shortage occurs when the amount of the developer 2 is insufficient at a portion near the downstream end of the supply path 7 relative to the direction of conveyance of the developer 2. Consequently, the developer 2 is not reliably supplied to the developing sleeve 14*a*, causing uneven image density. Clogging occurs when more of the developer 2 stays at the upside opening 11. Even when the tilt angle θ of the developing device 4 relative to the horizontal axis H is 0°, developer shortage and clogging was prevented by setting the rotation speed of each of the supply screw 9 and the recovery screw 10 to 1200 [rpm], providing normal images.

In the experiment, the tilt angle θ of the developing device 4 relative to the horizontal axis H was gradually increased. In a case in which the developing device 4 was tilted at the tilt angle θ in a range between 7° and 25°, it was confirmed that developer shortage was prevented even when the rotation speed of each of the supply screw 9 and the recovery screw 10 was reduced by 100 [rpm] to 150 [rpm] from 1200 [rpm]. Meanwhile, in a case in which the developing device 4 was tilted at the tilt angle θ in a range between 10° to 20°, it was confirmed that clogging was prevented even when the rotation speed of each of the supply screw 9 and the recovery screw 10 was reduced by 150 [rpm] to 200 [rpm] from 1200 [rpm].

Accordingly, the tilt angle θ of the developing device 4 according to the second illustrative embodiment is set in a range between 10° and 20° in order to prevent developer shortage and clogging and reduce the rotation speed of each of the supply screw 9 and the recovery screw 10 by 150 [rpm] to 200 [rpm] from 1200 [rpm]. The slower rotation speed of each of the supply screw 9 and the recovery screw 10 can prevent deterioration in the developer 2 and the developing device 4, extending the life of the developer 2 and the developing device 4.

It should be noted that the developing device 4 may be accidentally tilted relative to the horizontal axis H due to an installation error depending on an installation environment of the image forming apparatus 500. It is assumed that the tilt angle θ of the developing device 4 relative to the horizontal axis H caused by such an installation error is about ±5°. When the developing device 4 was tilted at such a tilt angle θ in the experiment, developer shortage and clogging were not sufficiently prevented. Therefore, it is considered that developer shortage and clogging may be prevented by tilting the developing device 4 at the tilt angle θ beyond the angle caused by the installation error.

Further, it was confirmed that the conveyance speed of the developer 2 in the recovery path 8 was considerably decreased when the tilt angle θ was too large. Consequently, the sufficient amount of the developer 2 could not be conveyed to the supply path 7. Therefore, there is an upper limit to the tilt angle θ.

According to the foregoing illustrative embodiments, the developing device 4 includes the developing sleeve 14*a* serving as a developer bearing member. The developing sleeve 14*a* is configured to bear the developer 2 on the surface thereof while in rotation and supply toner to the latent image formed on the surface of the photoconductor 1 at a portion opposite the photoconductor 1 to develop the latent image with the toner. The developing device 4 further includes the supply path 7 to convey the developer 2 in the axial direction of the developing sleeve 14*a* while supplying the developer 2 to the developing sleeve 14*a*, and the supply screw 9 rotated to convey the developer 2 in the supply path 7. The developing device 4 further includes the recovery path 8 to return the developer 2 from the downstream end to the upstream end of the supply path 7 relative to the direction of conveyance of the developer 2, and the recovery screw 10 rotated to convey the developer 2 in the recovery path 8. The bottom surface 7*b* of the supply path 7 is tilted relative to the horizontal axis H such that the bottom surface 7*b* at the downstream end of the supply path 7 relative to the direction of conveyance of the developer 2 is lower than the bottom surface 7*b* at the upstream end of the supply path 7. Accordingly, the developer 2 is conveyed to the downstream end of the supply path 7 relative to the direction of conveyance of the developer 2 by gravity as well as rotation of the supply screw 9. As a result, the amount of the developer 2 conveyed in the supply path 7 is increased without increasing the rotation speed of the supply screw 9. Further, stress to the developer 2 can be reduced, and unevenness in the amount of the developer 2 in the supply path 7 in the direction of conveyance of the developer 2 can be reduced compared with the related-art developing device 74 illustrated in FIG. 4.

In addition, the bottom surface 8*b* of the recovery path 8 is tilted such that the bottom surface 8*b* at the downstream end of the recovery path 8 relative to the direction of conveyance of the developer 2 is higher than the bottom surface 8*b* at the upstream end of the recovery path 8. Accordingly, the supply path 7 and the recovery path 8 are tilted in the same direction such that the downside opening 12 provided between the downstream end of the supply path 7 and the upstream end of the recovery path 8 relative to the direction of conveyance of the developer 2 is lower than the upside opening 11 provided between the upstream end of the supply path 7 and the downstream end of the recovery path 8 relative to the direction of conveyance of the developer 2. As a result, the developing device 4 can be downsized.

Each of the supply screw 9 and the recovery screw 10 includes a blade extending spirally along a length of the rotary axis thereof, and is rotated to convey the developer 2 in a given direction along the axis of the rotary axis thereof. The supply screw 9 and the recovery screw 10 are arranged such that a distance between the rotary axes of the supply screw 9 and the recovery screw 10 is equalized. Specifically, the rotary axis of the supply screw 9 is parallel to the rotary axis of the recovery screw 10. Accordingly, the supply path 7 and the recovery path 8 are tilted at the same angle in the same direction, downsizing the developing device 4. Further, because the supply screw 9 and the recovery screw 10 are parallel to each other, a distance between the recovery screw 10 and the supply screw 9 is not increased at a portion near the upside opening 11 at the downstream end of the recovery path 8 relative to the direction of conveyance of the developer 2. When the distance between the recovery screw 10 and the supply screw 9 is increased at that portion near the upside opening 11, the developer 2 is not effectively conveyed from the recovery path 8 to the supply path 7 at the upside opening 11. By contrast, in the developing device 4 according to the foregoing illustrative embodiments, the distance between the recovery screw 10 and the supply screw 9 is not increased at the portion near the upside opening 11, so that the developer 2 is effectively conveyed from the recovery path 8 to the supply path 7 at the upside opening 11.

In the developing device 4 according to the first illustrative embodiment, the rotary axis of the developing sleeve 14*a* is provided in the horizontal direction. Therefore, even the developing device 4 in which the supply path 7 and the recovery path 8 are tilted relative to the horizontal axis H can be employed in an image forming unit to form an image on a transfer sheet conveyed in the horizontal direction.

In the developing device 4 according to the second illustrative embodiment, the rotary axis of the developing sleeve 14*a* is parallel to the bottom surface 7*b* and the rotary axis of the supply screw 9. As a result, a length of the developing device 4 in a longitudinal direction can be reduced, downsizing the developing device 4.

In the developing device 4 according to the foregoing illustrative embodiments, the recovery path 8 is provided below the supply path 7 in a vertical direction. Accordingly, a width of the developing device 4 in the horizontal direction can be reduced, downsizing the developing device 4.

In the above-described configuration in which the recovery path 8 is provided below the supply path 7 in a vertical direction, the bottom surface 8*b* is tilted relative to the horizontal axis H such that the direction of conveyance of the developer 2 in the recovery path 8 is elevated. Specifically, a force is applied to the developer 2 in the horizontal and vertically upward directions in the recovery path 8. Accordingly, although the conveyance speed of the developer 2 in the horizontal direction is slightly reduced in the recovery path 8 compared with the related-art developing device 4 illustrated in FIG. 4 in which the developer 2 is conveyed only in the horizontal direction in the recovery path 78, nevertheless the developer 2 is conveyed in the vertically upward direction as well as the horizontal direction in the recovery path 8 of the developing device 4 according to the foregoing illustrative embodiments. Specifically, the developer 2 in the recovery path 8 is likely to be conveyed upward against gravity due to the vertically upward force generated by rotation of the recovery screw 10 even when the distance between the bottom surfaces 7*b* and 8*b* and the distance between the rotary axes of the supply screw 9 and the recovery screw 10 are the same as those of the related-art developing device 74. As a result, the developer 2 is effectively conveyed upward from the recovery path 8 to the supply path 7 at the upside opening 11 provided at the downstream end of the recovery path 8 in the developing device 4 according to the foregoing illustrative embodiments. Further, clogging of the developer 2 at the upside opening 11 can be prevented.

The developing device 4 is employed in the image forming apparatus 500 at least including the photoconductor 1, the charger, and the optical writing unit 21, so that a constant amount of the developer 2 is effectively supplied to the developing sleeve 14*a*, providing higher-quality images without uneven image density.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the spirit and scope of the present invention, and all such modifications as would be obvious to one skilled in the art are intended to be included within the scope of the following claims.

The number of constituent elements, locations, shapes and so forth of the constituent elements are not limited to any of the structure for performing the methodology illustrated in the drawings.

What is claimed is:

1. A developing device, comprising:

a developer container casing;

a developer bearing member housed partially within the developer container casing and rotated while bearing developer on a surface thereof to supply toner to a latent image to develop the latent image with the toner;

a supply path inside the developer container casing to convey the developer in an axial direction of the developer bearing member while supplying the developer to the developer bearing member;

a supply conveyance member disposed within the supply path to apply a force to the developer in the supply path to convey the developer;

a recovery path inside the developer container casing to return the developer reaching a downstream end of the supply path to an upstream end of the supply path relative to a direction of conveyance of the developer; and a recovery conveyance member disposed within the recovery path to apply a force to the developer in the recovery path to convey the developer, an interior of the developer container casing being divided by a partition that separates and defines the supply path and the recovery path, the partition containing a hole through which the supply path and the recovery path communicate, a bottom surface of the supply path tilted such that the bottom surface at the downstream end of the supply path relative to the direction of conveyance of the developer is lower than the bottom surface at the upstream end of the supply path, wherein a bottom surface of the recovery path is tilted such that the bottom surface at a downstream end of the recovery path relative to the direction of conveyance of the developer is higher than the bottom surface at an upstream end of the recovery path.

2. The developing device according to claim 1, wherein each of the supply conveyance member and the recovery conveyance member comprises a screw comprising a rotary shaft and a blade extending spirally along a length of the rotary shaft, each of the supply conveyance member and the recovery conveyance member is rotated to convey the developer in an axial direction of the rotary shaft thereof, and a distance between the rotary shafts of the supply conveyance member and the recovery conveyance member is kept constant.

3. The developing device according to claim 1, wherein the axial direction of the developer bearing member is horizontal.

4. The developing device according to claim 1, wherein the axial direction of the developer bearing member is parallel to the bottom surface of the supply path.

5. The developing device according to claim 1, wherein the recovery path is provided vertically below the supply path.

6. An image forming apparatus, comprising:

a latent image bearing member;

a charger to charge a surface of the latent image bearing member;

a latent image forming unit to form an electrostatic latent image on a surface of the latent image bearing member; and a developing unit to develop the electrostatic latent image with toner to form a toner image, wherein the developing unit comprises the developing device according to claim 1.

7. A developing device, comprising:

developer container means for containing developer;

developer bearing means housed partially within the developer container means and rotated while bearing developer on a surface thereof to supply toner to a latent image to develop the latent image with the toner;

supply means disposed inside the developer container means for conveying the developer in an axial direction of the developer bearing means while supplying the developer to the developer bearing means, and including supply conveyance means for applying a force to the developer in the supply means to convey the developer;

recovery means disposed inside the developer container means for returning the developer reaching a downstream end of the supply means to an upstream end of the supply means relative to a direction of conveyance of the developer, and including recovery conveyance means for applying a force to the developer in the recovery means to convey the developer; and partitioning means within the developer container means for separating and defining the supply means and the recovery means, the partition means containing a hole through which the supply means and the recovery means communicate, wherein a bottom surface of the supply means being tilted with respect to a horizontal plane such that the bottom surface at the downstream end of the supply means relative to the direction of conveyance of the developer is lower than the bottom surface at the upstream end of the supply means, and wherein a bottom surface of the recovery means is tilted such that the bottom surface at a downstream end of the recovery means relative to the direction of conveyance of the developer is higher than the bottom surface at an upstream end of the recovery means.

8. A developing device, comprising:

a developer container casing;

a developer bearing member housed partially within the developer container casing and rotated while bearing developer on a surface thereof to supply toner to a latent image to develop the latent image with the toner;

a supply path inside the developer container casing to convey the developer in an axial direction of the developer bearing member while supplying the developer to the developer bearing member;

a supply conveyance member disposed within the supply path to apply a force to the developer in the supply path to convey the developer;

a recovery path inside the developer container casing to return the developer reaching a downstream end of the supply path to an upstream end of the supply path relative to a direction of conveyance of the developer; and a recovery conveyance member disposed within the recovery path to apply a force to the developer in the recovery path to convey the developer, an interior of the developer container casing being divided by a partition that separates and defines the supply path and the recovery path, the partition containing a hole through which the supply path and the recovery path communicate, a bottom surface of the supply path tilted such that the bottom surface at the downstream end of the supply path relative to the direction of conveyance of the developer is lower than the bottom surface at the upstream end of the supply path, wherein the axial direction of the developer bearing member is parallel to the bottom surface of the supply path.

9. The developing device according to claim 8, wherein the recovery path is provided vertically below the supply path.

10. An image forming apparatus, comprising:

a latent image bearing member;

a charger to charge a surface of the latent image bearing member;

a latent image forming unit to form an electrostatic latent image on a surface of the latent image bearing member; and a developing unit to develop the electrostatic latent image with toner to form a toner image, wherein the developing unit comprises the developing device according to claim 8.

* * * * *